US007669284B2

(12) United States Patent
Newman

(10) Patent No.: US 7,669,284 B2
(45) **Date of Patent: *Mar. 2, 2010**

(54) BLOCK AND TACKLE WINDOW BALANCE WITH BOTTOM GUIDE ROLLER

(75) Inventor: Gary R. Newman, Valley Spring, SD (US)

(73) Assignee: Amesbury Group, Inc., Amesbury, MA (US)

( * ) Notice: Subject to any disclaimer, the term of this patent is extended or adjusted under 35 U.S.C. 154(b) by 52 days.

This patent is subject to a terminal disclaimer.

(21) Appl. No.: 12/018,382

(22) Filed: Jan. 23, 2008

(65) Prior Publication Data

US 2008/0115320 A1 May 22, 2008

Related U.S. Application Data

(63) Continuation of application No. 11/604,517, filed on Nov. 27, 2006, now Pat. No. 7,353,567, which is a continuation of application No. 11/029,074, filed on Jan. 4, 2005, now Pat. No. 7,155,778, which is a continuation of application No. 10/431,863, filed on May 7, 2003, now Pat. No. 6,877,187, which is a continuation of application No. 09/810,868, filed on Mar. 16, 2001, now Pat. No. 6,598,264.

(51) Int. Cl.
*E05F 1/10* (2006.01)

(52) U.S. Cl. ..... 16/197; 16/193; 49/446

(58) Field of Classification Search ..... 16/197, 16/196, 193, 212, 213, 210, 400, DIG. 16; 49/445–447, 414, 453, 463
See application file for complete search history.

(56) References Cited

U.S. PATENT DOCUMENTS

| | | | |
|---|---|---|---|
| 3,091,797 | A | 6/1963 | Prosser |
| 3,114,178 | A | 12/1963 | Wood |
| 3,358,403 | A | 12/1967 | Dinsmore |
| 3,358,404 | A | 12/1967 | Dinsmore |
| 3,440,683 | A | 4/1969 | Wood |
| 3,449,862 | A | 6/1969 | Biro |
| 4,089,085 | A | 5/1978 | Fitzgibbon |
| 4,134,234 | A | 1/1979 | Wood |

(Continued)

FOREIGN PATENT DOCUMENTS

| | | |
|---|---|---|
| CA | 2382933 | 12/2002 |

(Continued)

OTHER PUBLICATIONS

*Amesbury Group, Inc.*, v. *The Caldwell Manufacturing Co.*, Civil Action No. 05-10020-DPW, Defendant's Supplemented Answers to Plaintiffs' First Set of Interrogatories, dated Aug. 31, 2005, 5 pgs.

(Continued)

*Primary Examiner*—Chuck Y. Mah
(74) *Attorney, Agent, or Firm*—Goodwin Procter LLP

(57) ABSTRACT

Disclosed are apparatus for a block and tackle window balance to be incorporated in single and double hung window assemblies. In one embodiment the block and tackle window balance includes a roller secured within a bottom guide to increase range of travel of a window sash.

16 Claims, 10 Drawing Sheets

U.S. PATENT DOCUMENTS

| | | | |
|---|---|---|---|
| 4,190,930 | A | 3/1980 | Prosser |
| 4,238,907 | A | 12/1980 | Swan |
| 4,300,316 | A | 11/1981 | Ficurilli |
| 4,332,054 | A | 6/1982 | Paist et al. |
| 4,373,295 | A | 2/1983 | Starck |
| 4,413,445 | A | 11/1983 | Trout |
| 4,503,641 | A | 3/1985 | Swan |
| 4,586,291 | A | 5/1986 | Swan |
| 4,642,845 | A | 2/1987 | Marshik |
| 4,654,928 | A | 4/1987 | Flight |
| 4,672,713 | A | 6/1987 | Newton et al. |
| 4,689,850 | A | 9/1987 | Flight |
| 4,697,304 | A | 10/1987 | Overgard |
| 4,704,821 | A | 11/1987 | Berndt |
| 4,800,680 | A | 1/1989 | Westfall et al. |
| 4,914,862 | A | 4/1990 | Gregory |
| 4,949,425 | A | 8/1990 | Dodson et al. |
| 5,174,064 | A | 12/1992 | Stark |
| 5,530,991 | A | 7/1996 | deNormand et al. |
| 5,737,877 | A | 4/1998 | Meunier et al. |
| 6,041,476 | A | 3/2000 | deNormand |
| 6,467,128 | B1 | 10/2002 | Damani |
| 6,840,011 | B2 | 1/2005 | Thompson et al. |

FOREIGN PATENT DOCUMENTS

| | | |
|---|---|---|
| GB | 1 218 827 | 1/1971 |
| GB | 1 244 324 | 8/1971 |
| JP | 62-194895 | 12/1987 |

OTHER PUBLICATIONS

*Amesbury Group, Inc.,* v. *The Caldwell Manufacturing Co.,* Civil Action No. 05-10020-DPW, Defendant's Second Supplemented Answers to Plaintiffs' First Set of Interrogatories, undated, served Jan. 12, 2006, 11 pgs.

*Amesbury Group, Inc.,* v. *The Caldwell Manufacturing Co.,* Civil Action No. 05-10020-DPW, Memorandum and Order, dated Jan. 20, 2006, 74 pgs.

Memorandum and Order, *Amesbury Group, Inc.* v. *The Caldwell Manufacturing Company,* Civil Action No. 08-10171-DPW, dated Dec. 17, 2009.

Caldwell's Responses to Amesbury's First Set of Interrogatories (Nos. 1-17), *Amesbury Group, Inc.* v. *The Caldwell Manufacturing Company,* Civil Action No. 08-CV-10171-DPW, dated Jul. 9, 2008. (Partial).

Caldwell's Supplemented Responses to Amesbury's First Set of Interrogatories (Nos. 1-17), *Amesbury Group, Inc.* v. *The Caldwell Manufacturing Company,* Civil Action No. 08-CV-10171-DPW, dated Oct. 1, 2008. (Partial).

BLOCK AND TACKLE WINDOW BALANCE WITH BOTTOM GUIDE ROLLER

RELATED APPLICATIONS

This application is a continuation of U.S. application Ser. No. 11/604,517, filed on Nov. 27, 2006, which is a continuation of U.S. application Ser. No. 11/029,074, filed on Jan. 4, 2005, now U.S. Pat. No. 7,155,778, which is a continuation of U.S. application Ser. No. 10/431,863, filed on May 7, 2003, now U.S. Pat. No. 6,877,187, which is a continuation of U.S. application Ser. No. 09/810,868, filed on Mar. 16, 2001, now U.S. Pat. No. 6,598,264, and incorporates by reference herein those applications in their entireties and claims priority thereto.

TECHNICAL FIELD

This invention relates to block and tackle window balance devices for single and double hung windows and, more particularly, to a block and tackle window balance device that provides an increased range of travel within a window frame.

BACKGROUND INFORMATION

Hung window assemblies generally include a window frame, a lower window sash, an upper window sash, a pair of window jambs, two sets of jamb pockets, and at least one window balance device for offsetting the weight of a window sash throughout a range of travel within the window frame. Block and tackle window balance devices use a combination of a spring and pulleys located within a channel to balance the weight of the window sash at any position within the jamb pockets.

In some block and tackle window balance devices, the channel containing both the spring and pulleys is attached to the window sash, and a cord, which connects the pulleys together, is attached to a jamb mounting hook that is connected to a side jamb. A disadvantage of this type of device is that the travel distance of the window sash is limited by some of the pulleys located within the rigid channel interfering with the jamb mounting hook that attaches the window balance to the window jamb.

SUMMARY OF THE INVENTION

In general, in one aspect, the invention relates to a block and tackle window balance device for use with single and double hung windows that affords increased window opening travel distance. In one embodiment, the block and tackle window balance device includes a channel, a spring with a first end and a second end, a translatable pulley block unit, a fixed pulley block unit, a cord, a top guide, and a bottom guide with a bottom guide roller. The top and bottom guides are connected to opposite ends of the channel. The spring, the translatable pulley block unit, and the fixed pulley block unit are all located within the channel. The first end of the spring and the fixed pulley block unit are fixed at opposite ends of the channel. The second end of the spring is connected to the translatable pulley block unit. The translatable and fixed pulley block units are connected by the cord. The cord is threaded around both the translatable and fixed pulley block units and extends around the bottom guide roller located within the bottom guide.

In another embodiment, the block and tackle window balance device includes a top guide including a top angled portion and a bottom portion. The bottom portion of the top guide is connected to one end of the channel. In still another embodiment, the top angled portion of the top guide is sized to receive a member from a window sash.

In yet another embodiment, the block and tackle window device includes a bottom guide that extends beyond the rigid channel. In still yet another embodiment, the bottom guide of the device further includes a channel to receive a portion of a window sash.

In general, in one aspect, the invention relates to a method of providing increased travel of a window sash slidably mounted in a window frame. The method includes three steps. A first step is to provide a window assembly that includes a window frame with jambs with jamb pockets, an upper window sash, a lower window sash, and at least one block and tackle window balance device having a channel and a bottom roller for dispensing a cord. The channel has a first end and a second end. The bottom roller is mounted proximate to the second end of the channel with a first distance between the first end of the channel and the bottom roller. A second step is to remove the block and tackle window balance device from the window assembly. A final step is to provide and to install an increased travel window balance device. The increased window balance device has a channel with a first end and a second end and a bottom guide roller for dispensing a cord. The bottom guide roller is mounted proximate to the second end of the channel and a second distance is defined as the length between the first end of the channel and the bottom guide roller. The second distance of the increased window balance device is greater than the first distance of the removed block and tackle window balance device.

The foregoing and other objects, aspects, features, and advantages of the invention will become more apparent from the following description and from the claims.

BRIEF DESCRIPTION OF THE DRAWINGS

In the drawings like reference characters generally refer to the same parts throughout the different views. Also, the drawings are not necessarily to scale, emphasis instead generally being placed upon illustrating the principles of the invention.

DETAILED DESCRIPTION

Figure 1:
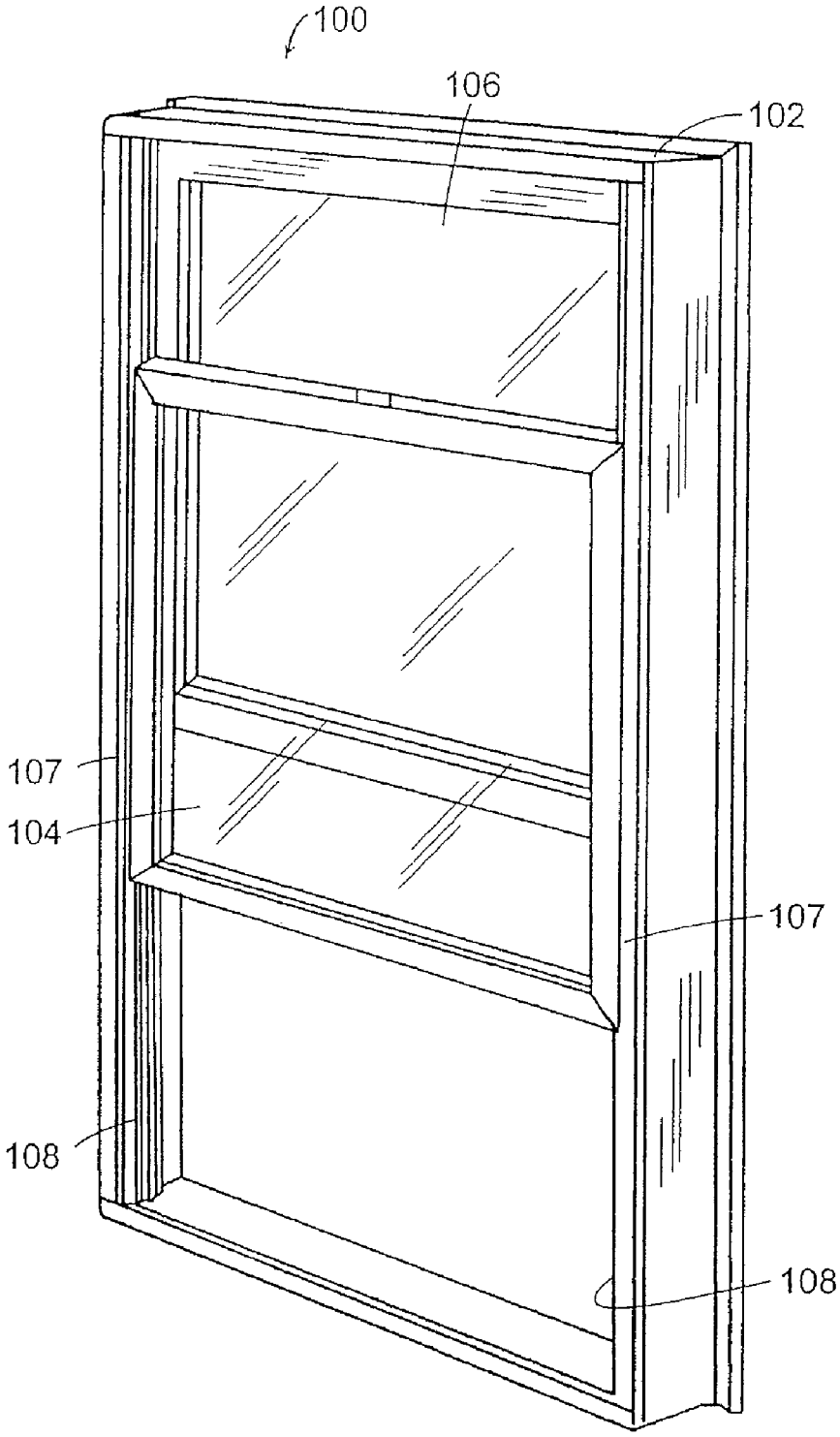
FIG. 1 PRIOR ART
FIG. 1 is a perspective view of a double hung window.

Referring to FIG. 1, shown is a double hung window assembly 100 in which a block and tackle window balance constructed in accordance with the teachings of the present invention can be used. The double hung window assembly 100 includes a window frame 102, a lower window sash 104, an upper window sash 106, and a pair of window jambs 107. Within each window jamb 107, jamb pockets 108 are defined. The lower window sash 104 and upper window sash 106 slide vertically within the jamb pockets 108. Generally, window balances are attached to the lower and upper window sashes 104, 106 to balance the weight of the window sashes at any vertical position within the jamb pockets 108.

Figure 2A:
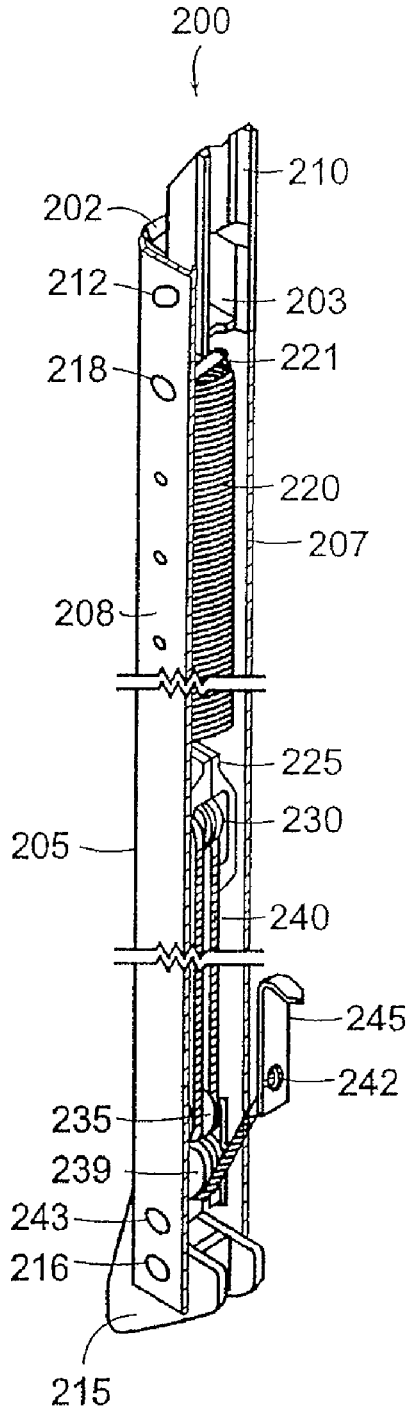
FIG. 2A PRIOR ART
FIG. 2A is a perspective view of a prior art block and tackle window balance.
Figure 2B:
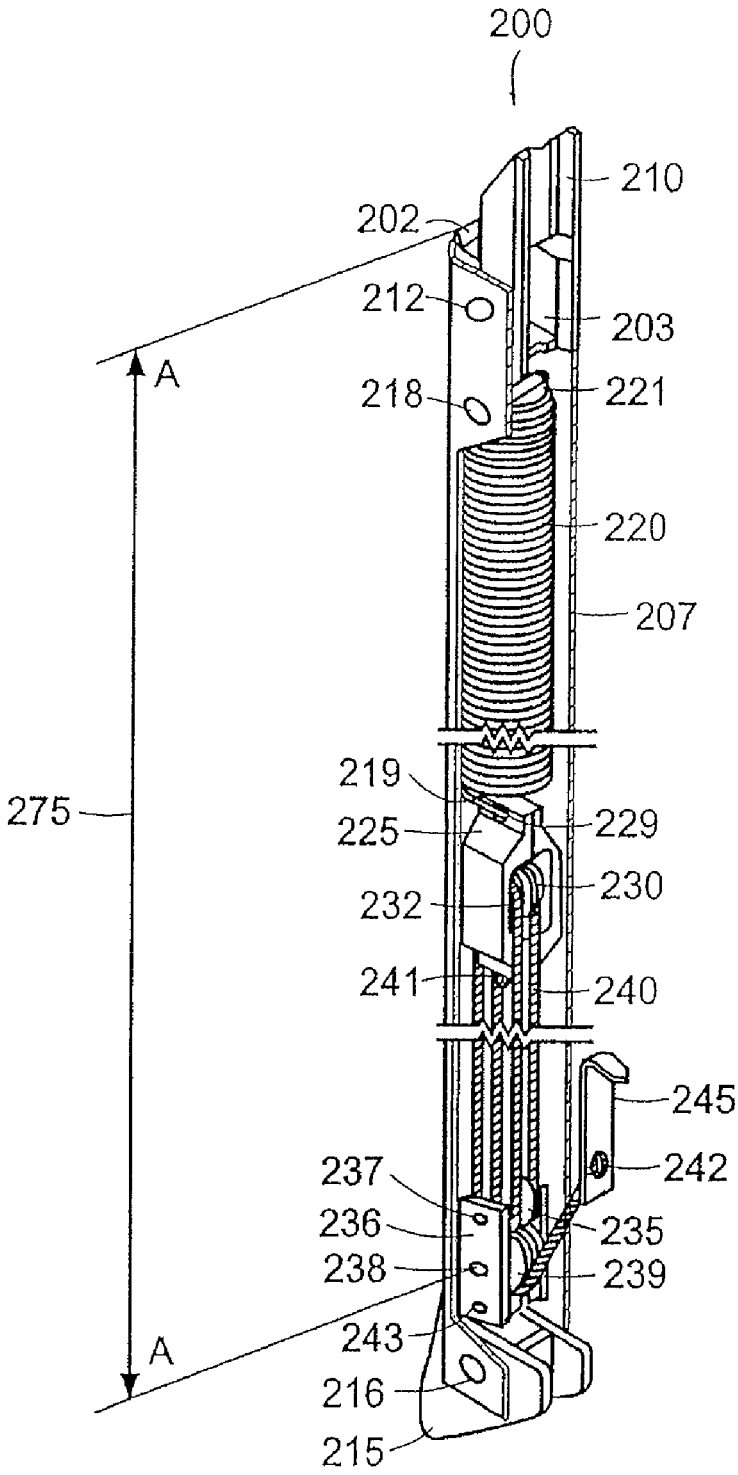
FIG. 2B PRIOR ART
FIG. 2B is another perspective view of the prior art block and tackle window balance of FIG. 2A with one of two side walls of the U-shaped channel removed.
Figure 3:
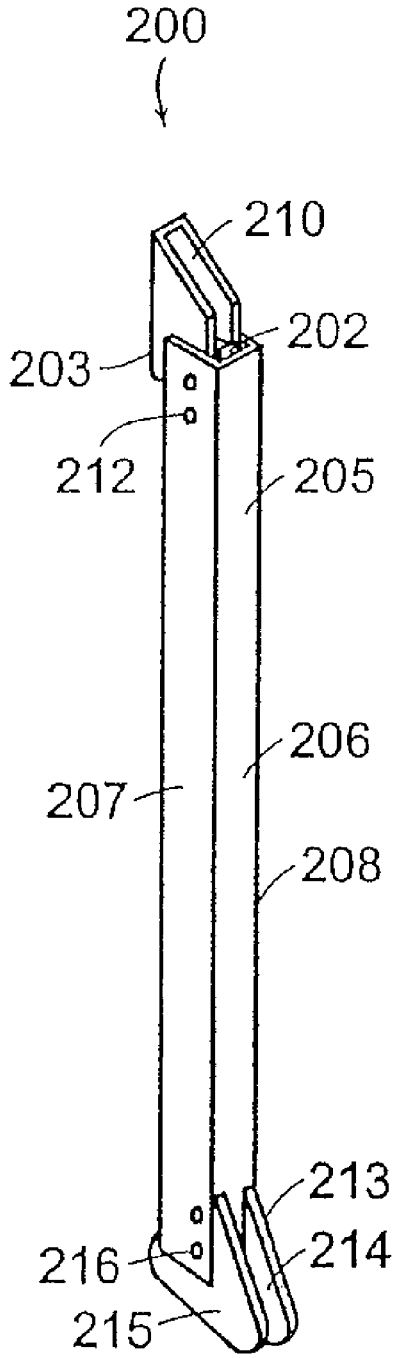
FIG. 3 PRIOR ART
FIG. 3 is a perspective rear view of the prior art block and tackle window balance.

FIGS. 2A, 2B, and 3 show perspective views of a prior art block and tackle window balance 200. FIG. 2A shows the prior art block and tackle window balance 200 in full, whereas FIG. 2B shows the prior art block and tackle window balance 200 with one side wall of a rigid U-shaped channel 205 cut away so that components within the window balance 200 are more visible. FIG. 3 shows a rear view of the window balance 200.

The block and tackle window balance 200 includes a spring 220, a translatable pulley unit 230, a fixed pulley unit 235, a roller 239, and a cord 240 all housed with the rigid U-shaped channel 205. Attached to the two ends of the rigid U-shaped channel 205 with fasteners 212, 216 are a top guide 210 and a bottom guide 215 that are used to connect the window balance 200 to either the upper or lower window sashes 104, 106 and to help guide the vertical motion of the window balance 200 within the jamb pockets 108. The top guide 210 includes an upper portion 202 and a lower portion 203. The upper portion 202 of the top guide 210 is angled and is sized to be received by a member attached to a window sash, such as a cam. The bottom guide 215 includes a back portion 213, best seen in FIG. 3, that encases a portion of the rigid channel 205. Within the back portion 213 of the bottom guide 215 is a channel 214 sized to receive a portion of a window sash.

The rigid U-shaped channel 205 has a back wall 206 and two side walls 207, 208 that in combination form the U-shape. The rigid U-shaped channel 205 serves as an external frame to which the components of the window balance 200 can be secured. The rigid U-shaped channel 205 also keeps components located within the rigid U-shaped channel 205 free of debris and particulate matter. The spring 220, the translatable pulley unit 230, the fixed pulley unit 235, and the roller 239 are located inside the rigid U-shaped channel 205. Both of the translatable pulley unit 230 and the fixed pulley unit 235 include one or more pulleys rotatable around respective axles.

Components within the rigid U-shaped channel 205 work in combination to create a force to counterbalance the weight of the attached sash at any vertical position within the window frame 102. These components are attached to each other such that a first end 219 of the spring 220 is connected to the translatable pulley unit 230, and the translatable pulley unit 230 is connected to the fixed pulley unit 235 and the roller 239 via the cord 240. A pulley in the fixed pulley unit 235 and the roller 239 may be contained in a frame 236. To secure the components within the rigid U-shaped channel 205, the second end 221 of the spring 220 and the frame 236 are fixed to opposite ends of the rigid U-shaped channel 205 via respective fasteners 218, 243. The frame 236 is also used to secure a pulley axle 237 and a roller axle 238, around which the pulley in the fixed pulley unit 235 and the roller 239 respectively rotate. A first distance "AA" 275 is defined by a length extending between the upper portion 202 of the top guide 210 and the roller axle 238. The spring 220 and the translatable pulley unit 230 are connected together by hooking the first end 219 of the spring 220 through an upper slot opening 229 in a frame 225. The frame 225 houses the translatable pulley unit 230 and a pulley axle 232 around which a pulley in the translatable pulley unit 230 rotates. The cord 240, which can be a rope, string, or cable, has a first end 241 and a second end 242. The first end 241 of the cord 240 is secured to the frame 225 and the second end 242, which is a free cord end, is threaded through the translatable pulley unit 230, the fixed pulley unit 235, and the roller 239, thereby connecting all three components together. After the cord 240 connects the three components together, a jamb mounting attachment 245 is secured to the second end 242 of the cord 240. When the prior art window balance 200 is located in the jamb pocket 108, the jamb mounting attachment 245 engages an opening 430 (FIG. 5) within one of the jamb pockets 108, securing the window balance 200 to the window jamb 107.

The spring 220 provides the force required to balance the sashes. The spring 220 is extended when the second end 242 of the cord 240 with the jamb mounting attachment 245 is pulled, causing the frame 225 to move within the rigid U-shaped channel 205 towards the frame 236, which is fixed. As the frame 225 moves towards the frame 236, the spring 220 is extended.

Figure 4A:
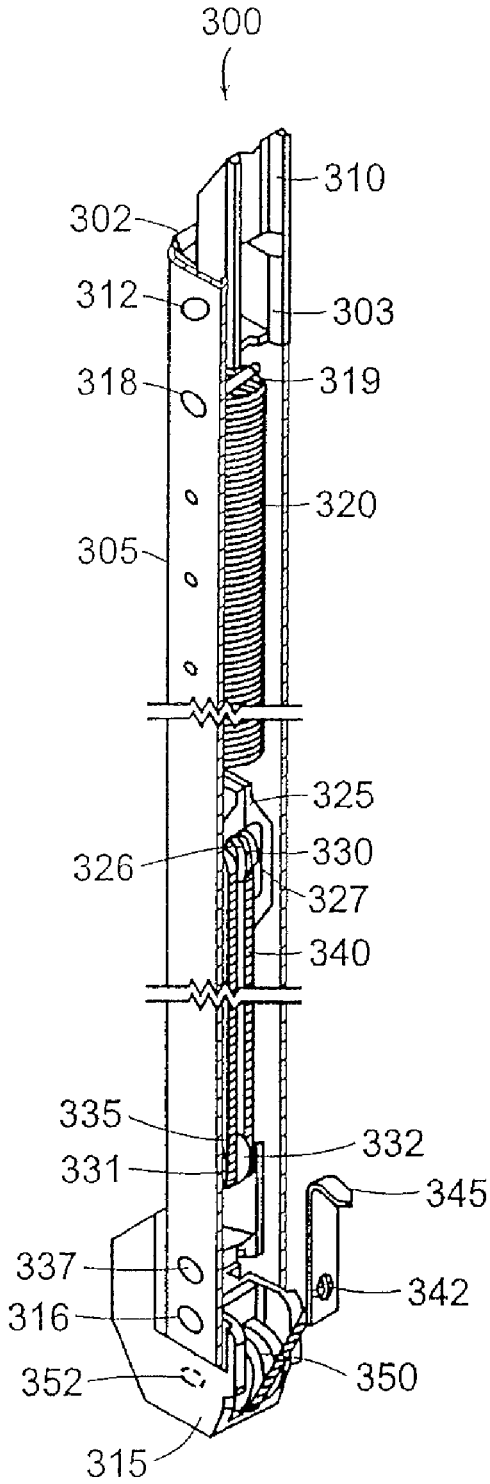
FIG. 4A is a perspective view of an embodiment of a block and tackle window balance of the invention.
Figure 4B:
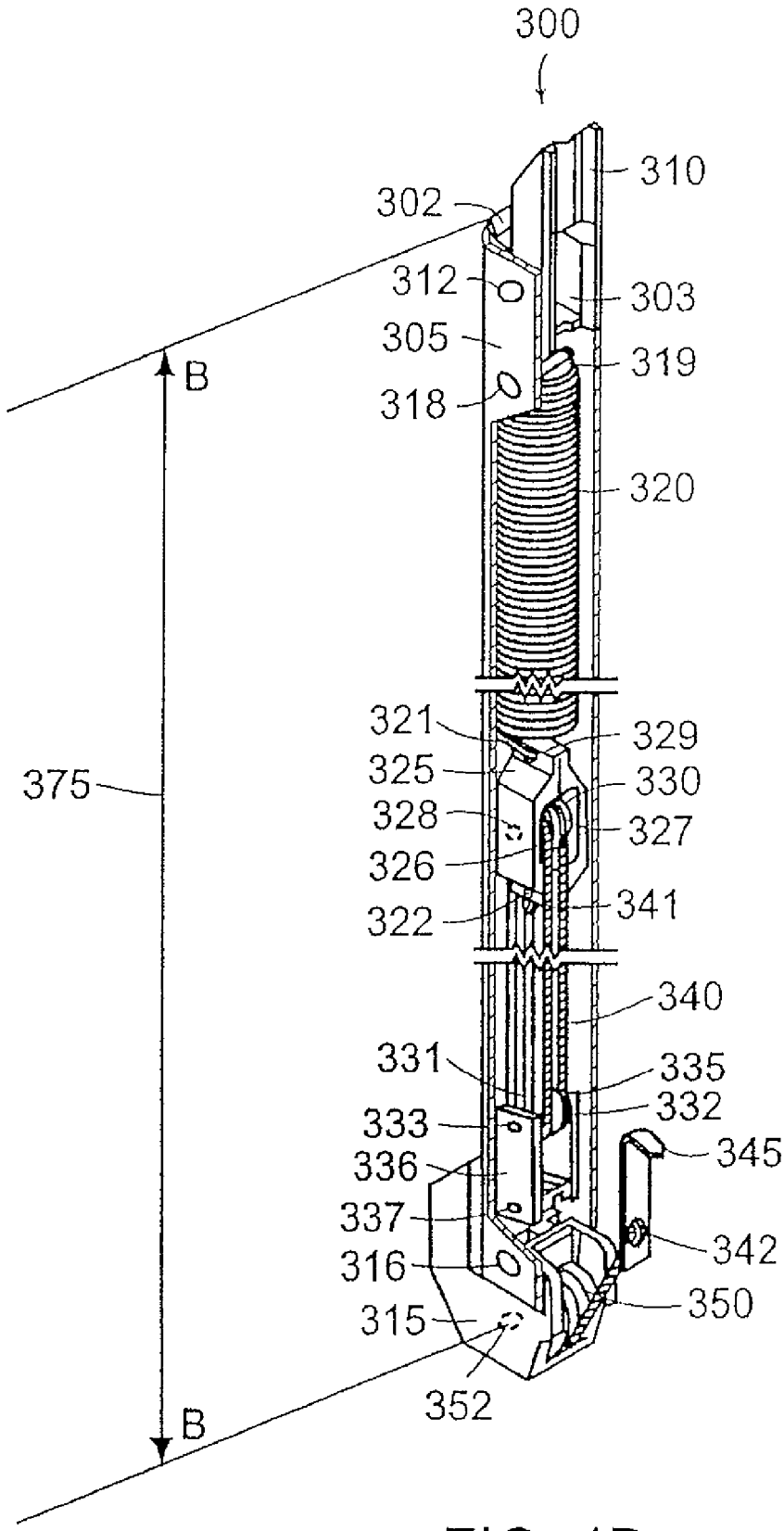
FIG. 4B is perspective view of the block and tackle window balance of FIG. 4A with one of two side walls of the U-shaped channel removed.
Figure 5:
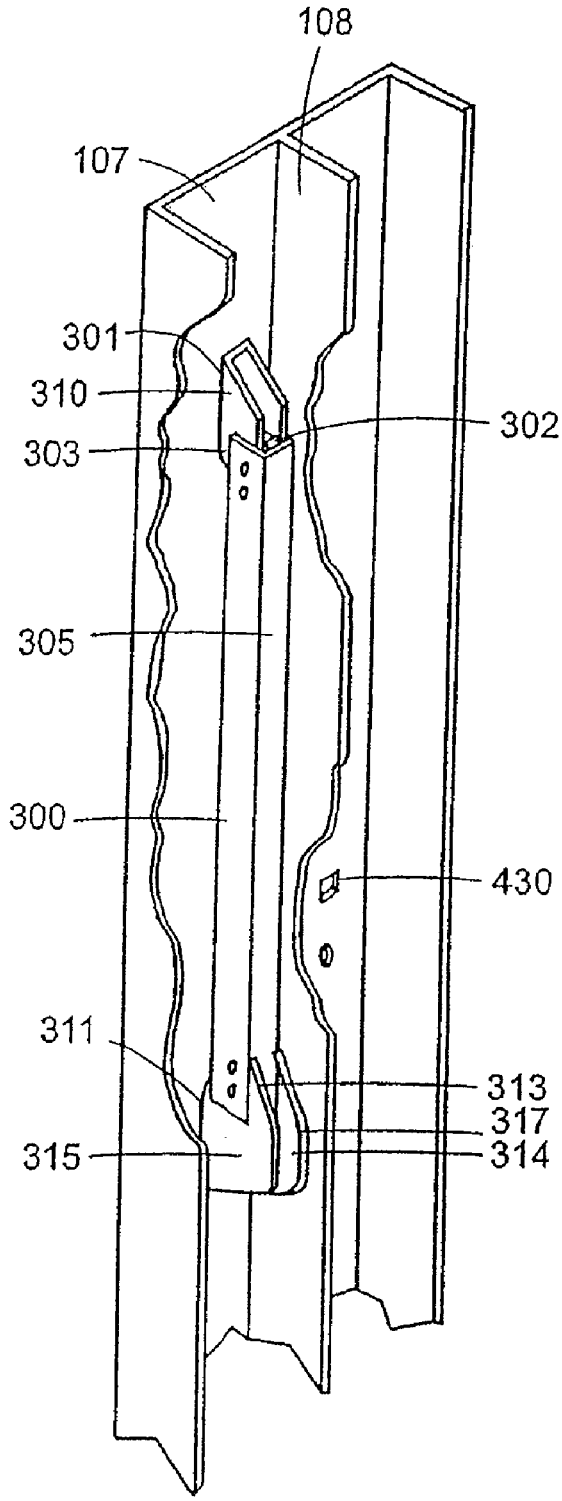
FIG. 5 is a perspective view of an embodiment of a block and tackle window balance of the invention mounted within a window jamb.

FIGS. 4A and 4B show an embodiment of a block and tackle window balance 300 in accordance with the teachings of the present invention. The window balances 300 act to counterbalance the weight of the window sashes 104, 106 at any vertical position within the window frame 102. FIG. 4A show one perspective view of the window balance 300 and FIG. 4B shows another perspective view of the same balance, but with a side wall of the rigid U-shaped channel 305 removed. The window balance 300 includes the rigid U-shaped channel 305, a top guide 310, a bottom guide 315, a spring 320, a translatable pulley unit 330, a fixed pulley unit 335, a bottom guide roller 350, and a cord 340. The top guide 310 and the bottom guide 315 are fixed to the rigid U-shaped channel 305 by fasteners 312, 316. The top guide 310 is used to help connect the block and tackle window balance 300 to the window sash 104, 106 and to help guide the movement of the block and tackle window balance 300 within the jamb pocket 108. The top guide 310 may include a top angled portion 302 and a bottom portion 303 as shown in FIGS. 4A and 4B. The bottom guide 315 is also used for connection and guidance purposes, but the bottom guide 315 further serves as a frame for housing the bottom guide roller 350. The bottom guide 315 extends beyond the rigid U-shaped channel 305 and, therefore, the bottom guide roller 350 is located outside of the rigid U-shaped channel 305. A back portion 313 of the bottom guide 315 may include a channel 314 for receiving a portion of the window sash, as depicted in FIG. 5. Some windows have a groove running along a bottom rail of the sash. On conventional balances, the bottom guide can drop into this groove so a manufacturer needs to use a shorter balance to avoid dropping into the groove. This effectively reduces the amount of travel, because shorter balances have to be used. The bottom guide 315 of the present invention is configured so the contact point of the bottom guide 315 to the sash is higher on the balance 300 so the groove is avoided and a longer balance with a greater spring force can be used. This can afford increased force for balancing the sash at any vertical position, as well as increased amount of travel resulting from the longer balance.

The spring 320, the translatable pulley unit 330, and the fixed pulley unit 335 are located within the rigid U-shaped channel 305. In the embodiment shown in FIGS. 4A and 4B, the translatable pulley unit 330 includes two pulleys 326, 327 that are rotatable about a single pulley axle 328. however, in other embodiments, the translatable pulley unit 330 may contain one or more pulleys rotatable about the pulley axle 328. Similarly, the fixed pulley unit 335, as shown in FIGS. 4A and 4B, includes two pulleys 331, 332 that rotate about a single pulley axle 333; however in other embodiments, the fixed pulley unit 335 may contain one or more pulleys that rotate about the pulley axle 333. A first end 319 of the spring 320 is fixed with respect to the rigid U-shaped channel 305 via a fastener 318. In the disclosed embodiment, the fastener is a rivet; however the fastener could also be a support member welded between the two side walls of the rigid U-shaped channel 305, a hook secured to or formed in the rigid U-shaped channel 305, or any other device which secures the first end 319 of the spring 320 to the rigid U-shaped channel 305. The second end 321 of the spring 320 is attached to a frame 325, which houses the translatable pulley unit 330. To connect the spring 320 to the frame 325, the second end 321 of the spring 320 hooks through an opening 329 in the frame 325. The cord 340 has a first end 341 and a second end 342. The first end 341 of the cord 340 is attached to the frame 325 through a frame opening 322. The second end 342 is attached to a jamb mounting hook 345. The cord 340 is threaded through the translatable pulley unit 330, the fixed pulley unit 335, and around the bottom guide roller 350, connecting the three components together. The cord 340 in the disclosed embodiment is a string, however it may also be a rope, or a cable. Both the fixed pulley unit 335 and the bottom guide roller 350 are fixed with respect to the rigid U-shaped channel 305. The fixed pulley unit 335 is housed within a frame 336 and rotates around the pulley axle 333. The frame 336 is secured within the rigid U-shaped channel 305 with a fastener 337. In an alternative embodiment, the frame 336 is not required, the fixed pulley unit 335 rotates around an axle supported between side walls of the rigid U-shaped channel 305. In yet another alternative embodiment, the fixed pulley unit 335 can be integral with the bottom guide 315 and as a result, fasteners 337 and 316 can be eliminated because tension of the spring 320 will keep the bottom guide 315 engaged with or connected to the rigid U-shaped channel 305. The bottom guide roller 350 is located within the bottom guide 315 and rotates around a bottom guide axle 352. A second distance "BB" 375 is defined as the length extending between the top angled portion 302 of the top guide 310 and the bottom guide axle 352. It should be noted that the second distance "BB" 378 is greater than the first distance "AA" 275 of the window balance 200.

Figure 6:
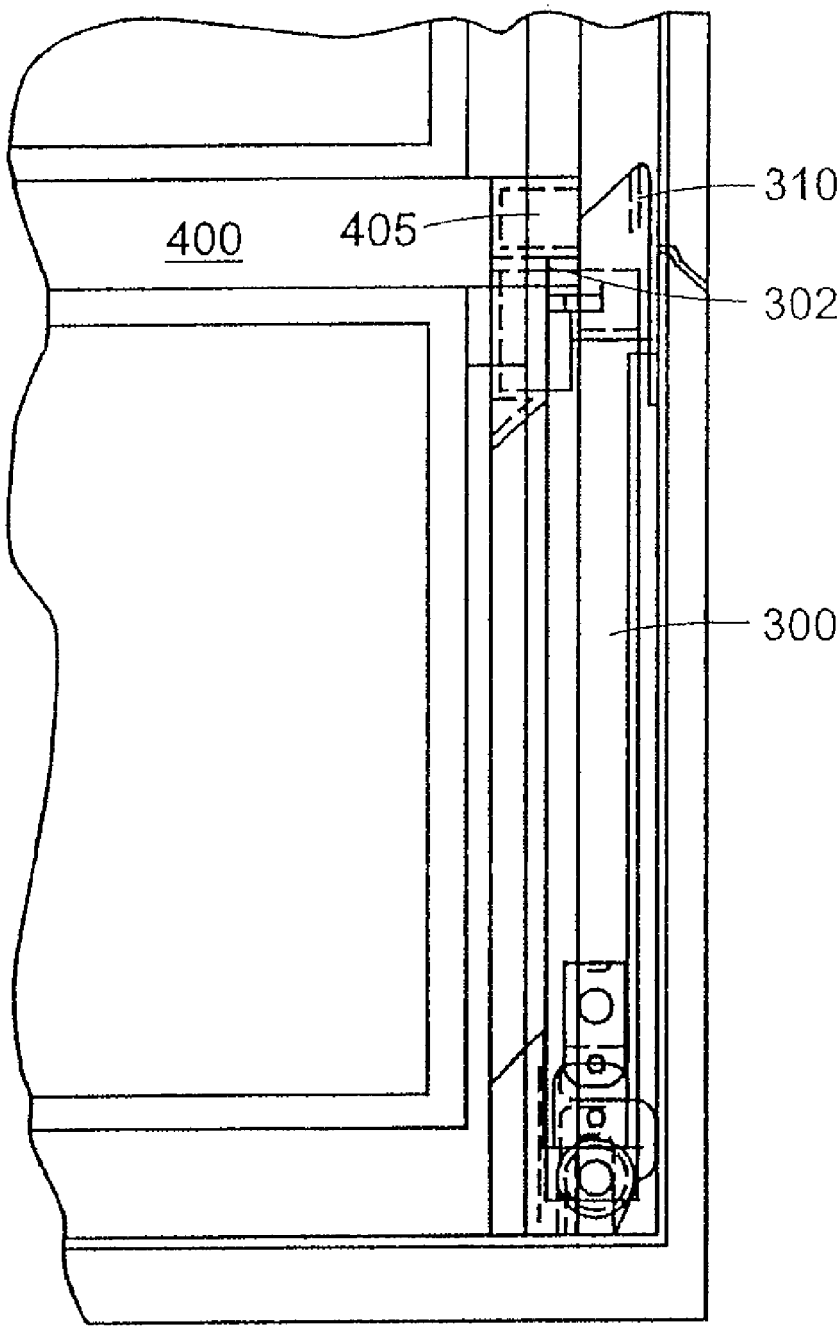
FIG. 6 is an enlarged front view of a top guide of the block and tackle window balance of FIG. 4A attached to a cam.

To use the block and tackle window balance 300 within the window assembly, the balance is connected to both the window jamb 107 and to either the lower window sash 104 or the upper window sash 106. Substantially vertical front portions 301, 311 of the top guide 310 and the bottom guide 315, respectively, help guide movement of the balance 300 when installed in the jamb pocket 108. Referring to FIG. 5, the block and tackle window balance 300 is attached to the window jamb 107 via the jamb mounting hook 345. The jamb mounting hook 345 is secured within an opening 430 within the jamb pocket 108. The window balance 300 is then connected to a window sash by inserting a portion of the window sash into the channel 314 (formed from walls having an angled portion 317) of the bottom guide 315 and connecting a cam 405 mounted on the top of the window sash 400 to the top angled portion 302 of the top guide 310, as shown in FIG. 6.

Figure 7B:
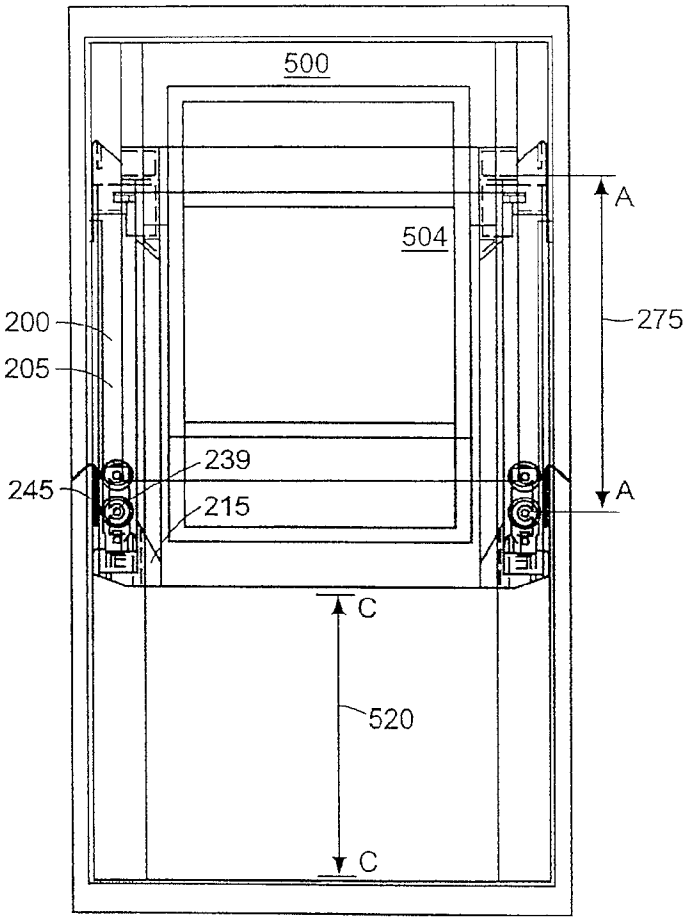
FIG. 7B PRIOR ART
FIG. 7B is a front view showing an open position of the window assembly with prior art block and tackle window balances.
Figure 7A:
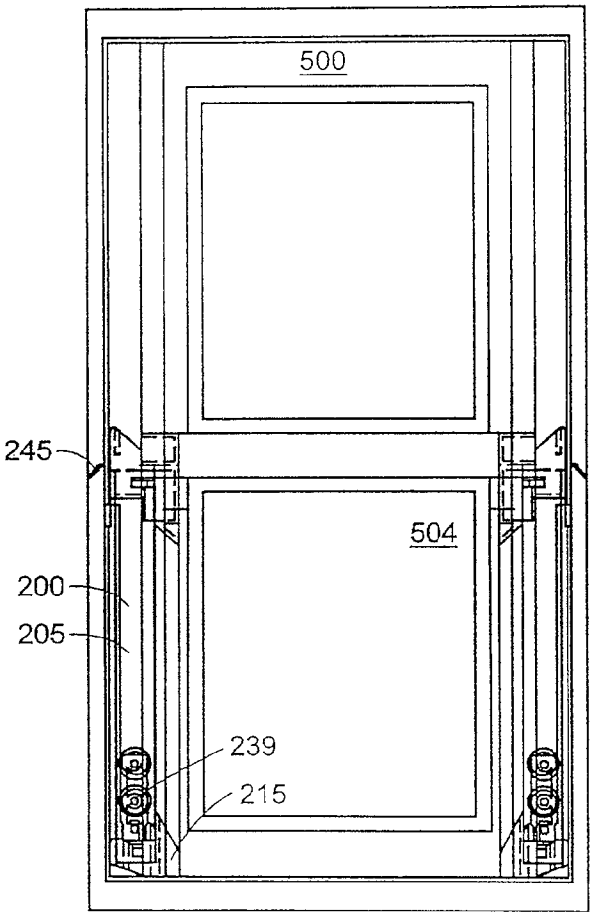
FIG. 7A PRIOR ART
FIG. 7A is a front view showing a closed position of a window assembly with prior art block and tackle window balances.

The spring 320 of the window balance 300 creates the force required to counterbalance the weight of the window sash. However, because the bottom guide roller 350 is located in the bottom guide 315, instead of within the rigid U-shaped channel 305 as in prior art balances, window sashes with the block and tackle window balances 300 as disclosed in this application provide greater travel distance. FIG. 7A is an illustration of a window assembly 500 with two prior art window balances 200 attached to a lower window sash 504. In FIG. 7A, the lower window sash 504 is in a closed position. FIG. 7B shows the window assembly 500, but with the lower window sash 504 in a fully open position. The standard travel distance of a window sash attached to the prior art window balance 200 is labeled "CC" 520 in FIG. 7B. The window sash 504, as shown in FIGS. 7A and 7B, is prevented from achieving a greater travel distance by the roller 239, located within the rigid U-shaped channel 205, hitting the jamb mounting hook 245.

Figure 8B:
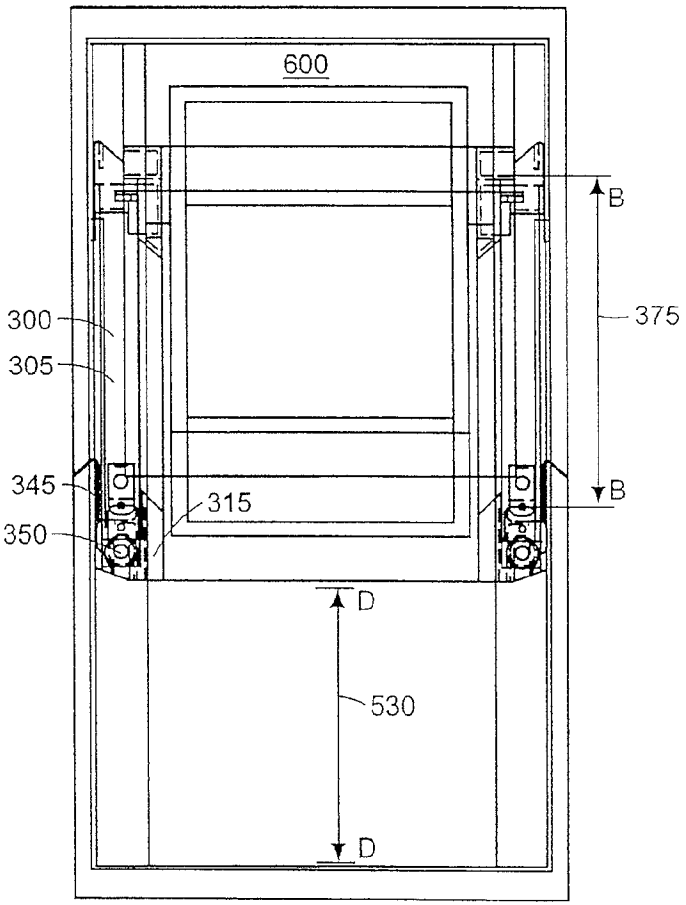
FIG. 8B is a front view showing an open position of a window assembly with block and tackle window balances of the invention.
Figure 8A:
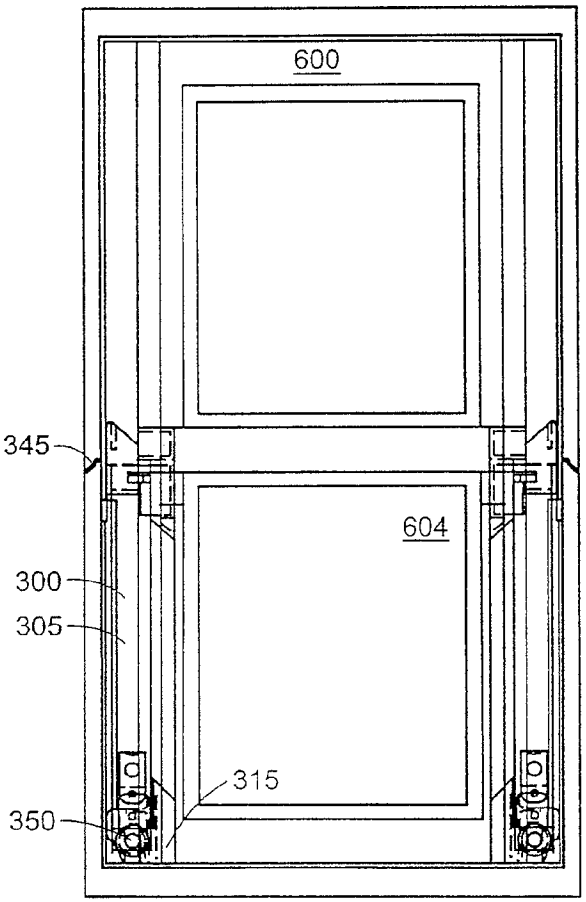
FIG. 8A is a front view showing a closed position of a window assembly with an embodiment of a block and tackle window balances of the invention.

FIGS. 8A and 8B show a schematic of the window assembly 600 with block and tackle balances 300 of the present invention. FIG. 8A shows the window assembly 600 in the closed position, while FIG. 8B shows the window assembly 600 in the fully open position. Because the bottom guide roller 350 is mounted within the bottom guide 315 instead of within the rigid U-shaped channel 305, the window sash 604 can travel a greater distance before the bottom guide roller 350 hits the jamb mounting hook 345, resulting in a greater travel distance, labeled "DD" 530 in FIG. 8B. It should be noted that the distance "DD" 530 is greater than the distance "CC" 520. The greater travel distance is an important feature, because it allows for an increased window clearance that will help persons who are using the window assembly as an emergency exit.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A block and tackle window balance device adapted for traveling with a window sash, the block and tackle window balance device comprising:

a channel;

a top guide secured proximate a top end of the channel;

a bottom guide secured proximate a bottom end of the channel, the bottom guide comprising a substantially vertical portion adapted to guide the balance device with a window sash along a rear wall of a window jamb surface when installed in a window jamb;

a fixed pulley block fixed relative to the channel;

a translatable pulley block unit moveable within the channel;

a spring comprising a first end and a second end, wherein the first end is fixed relative to the channel and the second end is connected to the translatable pulley block unit;

a cord comprising a first cord end and a second cord end; and a roller for dispensing the cord, wherein at least a portion of the roller is located below the substantially vertical portion of the bottom guide when installed in a window jamb, and wherein the cord is threaded through the translatable pulley block unit and the fixed pulley block unit and extends around the roller, the first cord end being attached to the translatable pulley block unit and the second cord end being attachable to a jamb.

2. The block and tackle window balance device of claim 1, wherein the roller is disposed proximate a bottom end of the balance device.

3. The block and tackle window balance device of claim 1, wherein the roller is at least partially disposed in the channel.

4. The block and tackle window balance of claim 1, wherein the channel comprises a U-shaped cross section.

5. The block and tackle window balance device of claim 1, wherein the roller is rotatably secured to the bottom guide.

6. The block and tackle window balance device of claim 5, wherein the roller is secured at least partially within the bottom guide.

7. The block and tackle window balance device of claim 6, wherein the roller comprises a bottom guide roller.

8. The block and tackle window balance device of claim 1, wherein the bottom guide comprises unitary construction.

9. The block and tackle window balance device of claim 1, wherein the bottom guide is fixed to the channel with a rivet.

10. The block and tackle window balance device of claim 1, wherein the fixed pulley block is secured to the bottom guide.

11. The block and tackle window balance device of claim 10, wherein the fixed pulley block is integral with the bottom guide.

12. The block and tackle window balance of claim 1, further comprising an axle fixed with respect to the channel, wherein the roller rotates around the axle.

13. A block and tackle window balance device adapted for traveling with a window sash, the block and tackle window balance device comprising:

a channel comprising a top end and a bottom end;

a means for guiding the balance device with a window sash when installed, wherein the guiding means is located proximate the top end and the bottom end of the channel, and wherein the guiding means proximate the bottom end of the channel comprises a bottom guide;

a fixed pulley block fixed relative to the channel;

a cord comprising a first cord end and a second cord end; and a roller adapted for dispensing the cord, the roller fixed relative to and located proximate the bottom end, wherein at least a portion of the roller is located below the guiding means at the bottom end, and wherein the cord is threaded through the fixed pulley block unit and extends around the roller, and wherein the cord comprises a cord end being attachable to a jamb.

14. The block and tackle window balance device of claim 13, wherein the guiding means comprises a substantially vertical guiding surface.

15. The block and tackle window balance device of claim 13, wherein at least one of the bottom guide, the roller, and the fixed pulley block are fixed to the channel with a rivet.

16. The block and tackle window balance device of claim 15, wherein the roller is located at least partially in the bottom guide.

* * * * *